US006250348B1

(12) United States Patent
Reinholdt

(10) Patent No.: US 6,250,348 B1
(45) Date of Patent: Jun. 26, 2001

(54) REFUELING NOZZLE

(75) Inventor: James W. Reinholdt, Huntington Beach, CA (US)

(73) Assignee: J. C. Carter Company, Inc., Costa Mesa, CA (US)

( * ) Notice: Subject to any disclaimer, the term of this patent is extended or adjusted under 35 U.S.C. 154(b) by 0 days.

(21) Appl. No.: 09/493,711

(22) Filed: Jan. 28, 2000

Related U.S. Application Data

(60) Provisional application No. 60/118,663, filed on Jan. 29, 1999.

(51) Int. Cl.[7] ..... B65B 1/04

(52) U.S. Cl. ..... 141/382; 141/350; 141/301; 220/86.2; 137/614.04

(58) Field of Search ..... 141/346, 348, 141/349, 351–355, 290–293, 59, 301, 302, 382, 387–389; 137/614.04, 614.05; 222/86.2

(56) References Cited

U.S. PATENT DOCUMENTS

| | | |
|---|---|---|
| 3,662,793 | 5/1972 | Calisher et al. . |
| 3,674,061 | 7/1972 | Calisher et al. . |
| 3,734,149 | 5/1973 | Hansel . |
| 3,790,126 | 2/1974 | Ostand et al. . |
| 3,851,852 | 12/1974 | Blanchard et al. . |
| 3,885,608 | 5/1975 | Ayres . |
| 4,898,395 | 2/1990 | Kawase . |
| 4,941,587 | 7/1990 | Terada . |
| 5,056,570 | 10/1991 | Haris et al. . |
| 5,634,505 | 6/1997 | Wong . |
| 5,878,798 | 3/1999 | Harris et al. . |

*Primary Examiner*—Steven O. Douglas
(74) *Attorney, Agent, or Firm*—Fay, Sharpe, Fagan, Minnich & McKee, LLP

(57) ABSTRACT

An improved refueling system is provided for faster and safer pit stop refueling of a race car during a race. The refueling system is particularly designed for faster gravity drain flow of fuel from a pitside fuel tank to a fuel cell on the race car. The refueling system comprises an improved fuel nozzle adapted for quick and easy engagement with a mating receiver on the race car. In the course of engaging the fuel nozzle with the receiver, a poppet-type valve in the nozzle is moved to a full-open position defining a substantially unobstructed flow path for fuel flow through the nozzle at a substantially optimized flow rate to achieve refueling of the race car in the shortest possible time. The fuel nozzle is quickly and easily disengaged from the car receiver, and such disengagement is accompanied by automatic closure of the poppet-type valve.

21 Claims, 3 Drawing Sheets

REFUELING NOZZLE

CROSS-REFERENCE TO RELATED APPLICATIONS

This application claims the priority benefit of U.S. provisional application Serial No. 60/118,663, filed Jan. 29, 1999.

BACKGROUND OF THE INVENTION

1. Field of the Invention

This invention relates generally to refueling nozzles for use in rapid yet safe refueling of a race car. More specifically, this invention relates to an improved fuel nozzle for achieving faster and safer refueling of a race car during a pit stop.

2. Discussion of the Art

Modern automobile racing is an extremely popular spectator sport which attracts the attention of millions of fans throughout the world. Modern race cars are the culmination of sophisticated and costly engineering technologies, including structural frames and materials, aerodynamic designs, and specialized engines. Professional race teams literally spend millions of dollars to develop and maintain a modern race car for competition in several racing events over the course of a single racing season. Competition among these professional race teams for sponsorship money is intense and the pressure to succeed on the race track is great.

In recent years, the development of race car technology has proceeded in parallel with efforts to improve car and driver safety. To this end, the design and capacity of fuel tanks or fuel cells on the race car have evolved in efforts to reduce the potential of explosion and/or fire in the event of a mishap on the race course. Similarly, considerable attention has been given to preventing fuel spillage in the pits when a race car is refueled. Limiting the potential for an explosion and/or fire in the pits is of special concern in view of the presence of multiperson pit crews.

By way of further example, over the past few decades, the on-board fuel capacity of a typical race car has been progressively reduced so that the cars carry less fuel during a race, thereby reducing the chances of fuel spillage and/or fire should a mishap occur. This reduction in fuel tank capacity, however, has necessitated a greater number of pit stops during a typical race event. In this regard, although tire changes and other service activities may be performed during a routine pit stop, the duration of most pit stops is related primarily to the time needed to refill the fuel cell on the car so that the car can resume the race. For any car to be competitive, it is essential for the cumulative time in the pits to be as short as possible. As a race progresses, the speed and efficiency of each pit stop increases to create, in effect, a secondary race among pit crews that can be equally important to the primary race on the track. With this in mind, improvements in refueling safety are needed.

Refueling systems for race cars are the subject of specific rules and regulations aimed at preventing safety compromises in order to achieve faster car refueling times. Generally, the fuel flows by gravity through a fuel hose and nozzle to a fuel receiver on the car. Such nozzle-receiver connection opens a fuel flow valve in the nozzle to permit gravity drainage of fuel from the pitside tank to the car fuel cell.

Several problems are present in the prior art. One such problem is fuel spillage. This occurs because the refueling nozzle is not restricted to only opening when fully engaged with the receiver. As a result, the refueling nozzle opens prior to insertion into the receiver and substantial spillage occurs. The same problem exists when the refueling nozzle is removed from the receiver.

Another problem is the insufficient fuel flow rate through the fuel nozzle. The reduced flow rate often occurs because an internally supported poppet valve is used in the nozzle which impedes the flow of fuel into the receiver.

U.S. Pat. No. 5,634,505 is commonly owned with the present application and the details of that refueling system are incorporated herein by reference.

BRIEF SUMMARY OF THE INVENTION

A refueling system for delivering fuel from a pitside gas can to a receiver on a race car is provided.

The present invention relates to a race car refueling system of the gravity drain type wherein an improved fuel nozzle permits fuel flow to the car at a comparatively faster flow rate and additional safety. By reducing the refueling time needed for each pit stop, the refueling system of the present invention permits a race car to be more competitive particularly during long distance races, by significantly reducing the cumulative time spent in the pits.

The refueling system includes a receiver, an improved fuel nozzle, and a hose for connecting the fuel nozzle to a pitside fuel tank. The nozzle features a large cross-sectional fuel passage capable of discharging fuel into a race car in a short period of time without any fuel spillage.

The increased fuel flow rate through the nozzle is achieved by the provision of an externally supported poppet-style valve at a head of the fuel nozzle. A leakproof design is achieved by using first and second main independent seals. The first seal maintains a tight connection between components of the poppet-style valve when in the closed position particularly when the fuel nozzle is disengaged from the receiver. The second seal secures the connection between the fuel nozzle and the receiver during the refueling operation.

One advantage of the present invention is the provision of a new and improved refueling nozzle.

Another advantage of the present invention is the provision of a refueling nozzle which includes a self-aligning nose retainer.

Still another advantage of the present invention is the provision of a refueling nozzle that requires no levers to cock or keyways to align when attaching the nozzle to a receiver.

Yet another advantage of the present invention is the provision of a refueling nozzle which includes a plurality of flexible seals preventing spillage.

An additional advantage of the present invention is the provision of a refueling nozzle which includes an optimized high speed flow path.

A further advantage of the present invention is the provision of a refueling nozzle including a rugged design manufactured from high strength, low weight aluminum alloys.

Still another advantage of the present invention is the provision of a refueling nozzle of modular construction which requires only simple maintenance.

Yet another advantage of the present invention is the provision of a refueling nozzle that includes fire safe operation in hazardous pit areas.

Another advantage of the present invention is the lack of any internal structural support for the poppet valve which allows an increased fuel flow rate through the refueling nozzle.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts, preferred embodiments of which will be described in detail in this specification and illustrated in the accompanying drawings.

DETAILED DESCRIPTION OF THE PREFERRED EMBODIMENTS

Figure 1:
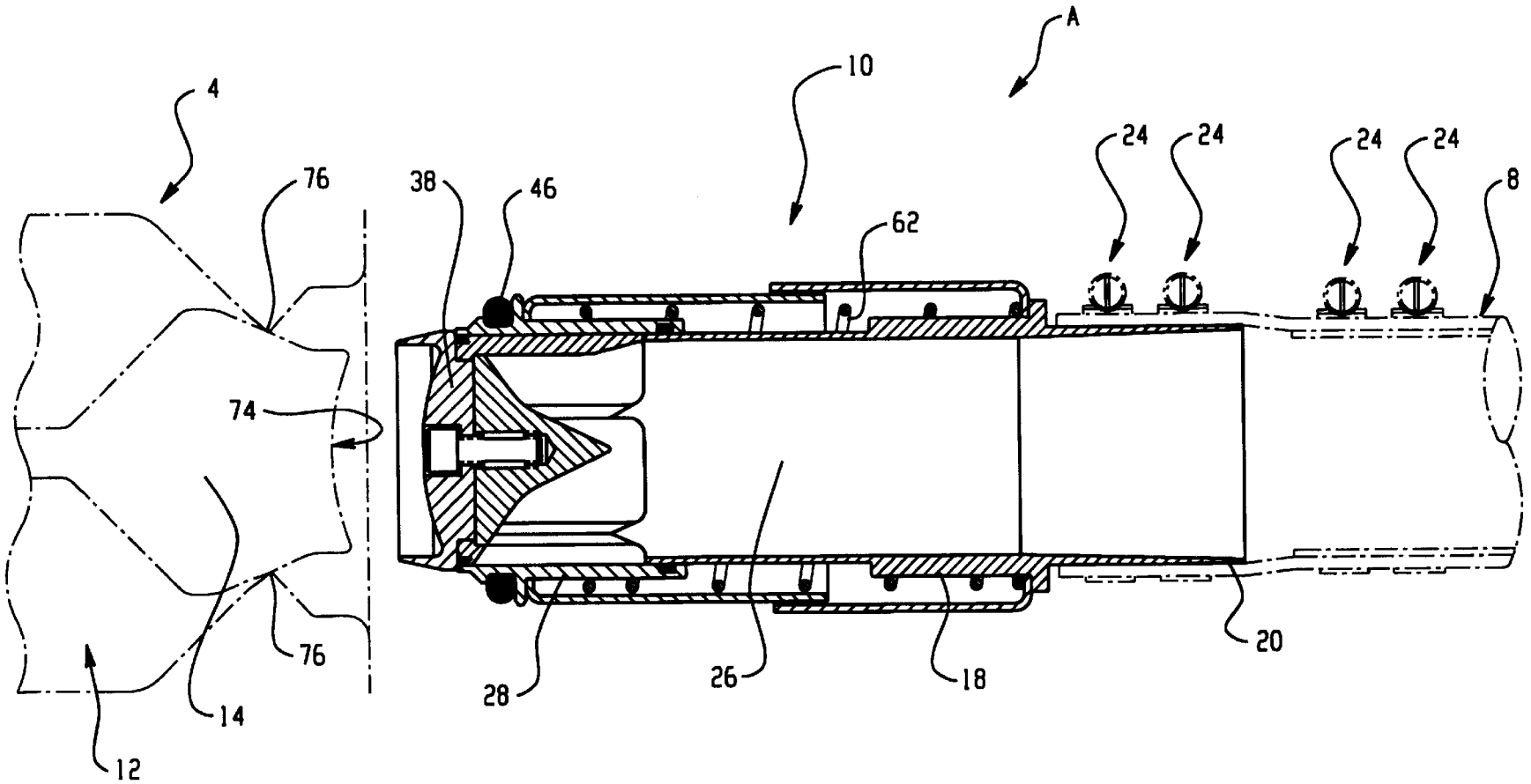
FIG. 1 is a sectional view depicting an improved fuel nozzle, with a receiver and a hose shown in phantom.

Referring now to the drawings, the showings are for purposes of illustrating preferred embodiments of the invention only and not for purposes of limiting the same, FIG. 1 shows an improved refueling system A in accordance with the invention. The refueling system A includes a receiver 4, a hose 8, and a fuel nozzle 10. The receiver 4 includes a fuel inflow port 12 and a shut-off valve member 14. The shut-off valve member 14 is held by a biasing means such as a spring (not shown) in a closed position obstructing the flow path of the fuel inflow port 12 of the receiver 4. The shut-off valve member 14 is movable against the spring and away from the receiver opening 16 which opens the fuel inflow port 12 in a manner generally known in the art.

The fuel nozzle 10 is preferably a generally tubular and hollow nozzle housing 18 having a first or aft end 20 adapted for clamp-on or other suitable connection to an end of a fuel hose 8. In one embodiment the clamp-on may comprise one or more hose clamps 24. The other end of the fuel hose 8 attaches to a pitside gas can (not shown). As will be appreciated from the drawing, the nozzle housing 18 defines a fuel flow path 26 of relatively large cross sectional area.

Figure 2:
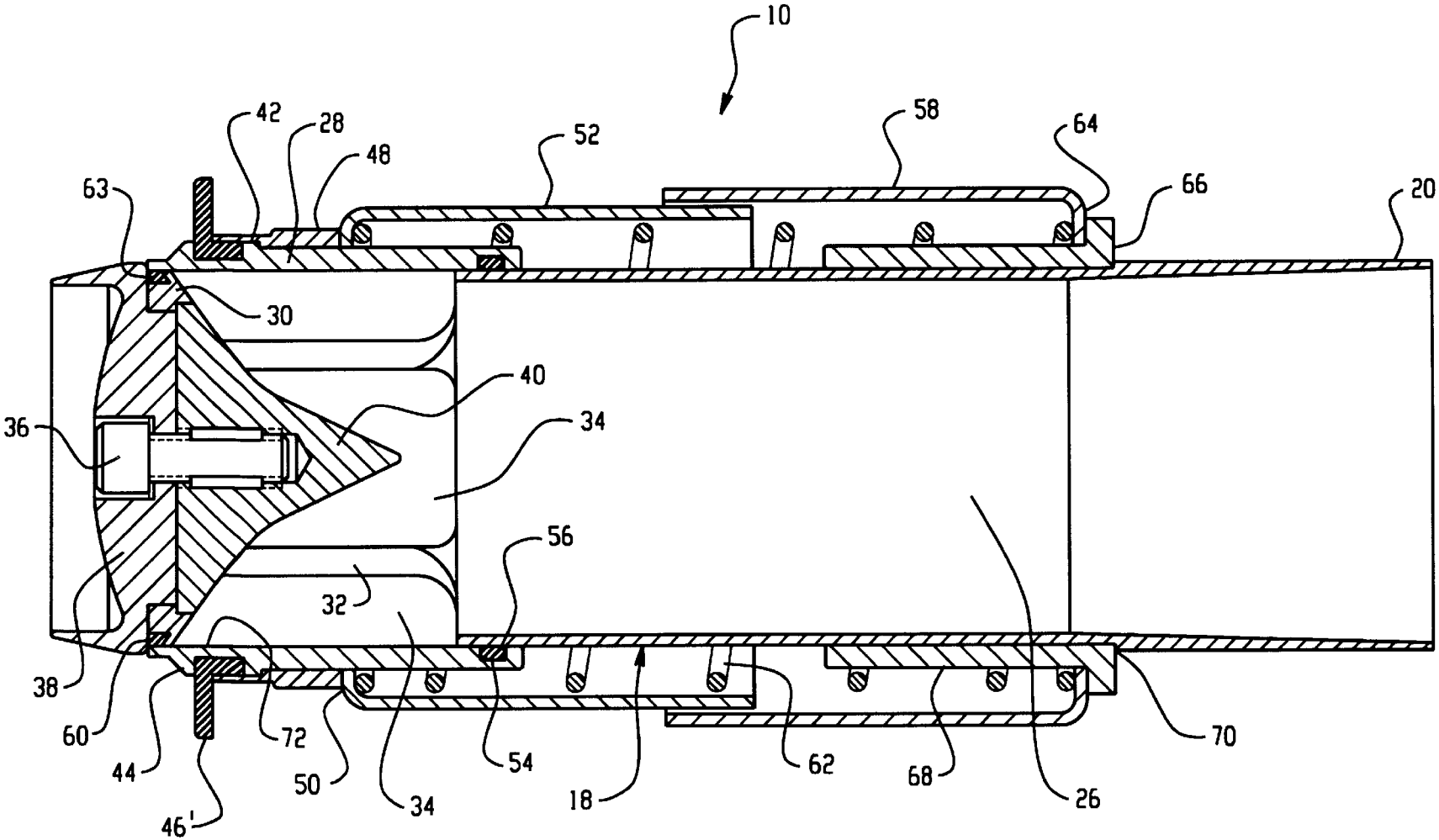
FIG. 2 is an enlarged sectional view depicting an improved fuel nozzle in accordance with the invention.

FIG. 2 is substantially identical to the embodiment of FIGS. 1 and 3 and thus like reference numerals will identify like components and new numerals will identify new components (the principal difference being associated with the shape of a seal and the retaining mechanism therefor as will be described below). A nose sleeve 28 is carried at a second or nose end of the fuel nozzle 10 and serves as a valve component for regulating fuel flow. More specifically, the nozzle housing 18 includes a rimmed surface 30 supported by relatively thin axial webs 32 at an outer or leading edge of the nozzle housing 18, such that axial webs 32 space the rimmed surface 30 axially forwardly of the housing 18 to define discharge ports 34 that open in a radial direction and have a total flow area equal to or exceeding the flow area of the housing flow path 26. A suitable fastener, such as screw 36, secures a retainer 38 and a cone 40 to the rimmed surface 30, together defining a closed end of the nozzle housing 18. Thus, the nose sleeve 28 and the hollow nozzle housing 18 with the retainer 38 and the cone 40 combine to create a poppet-type valve.

The nose sleeve 28 further includes a radial flange 42 and an angled retaining flange 44 that axially capture or retain a nozzle seal 46 therebetween. The seal is secured in a radial direction by a seal retainer 48 carried by the nose sleeve 28. The seal retainer 48 conforms to the contour of the nose sleeve 28 and the nozzle seal 46' and is further supported by a mounting flange 50 of inner spring cover 52. The nose sleeve 28 also includes an internal groove 54 which retains a rod seal 56 for sliding engagement with the external surface of the nozzle housing 18. The rod seal prevents fuel leakage into the spring chamber substantially defined by the annular space between the inner spring cover 52 and outer spring cover 58.

The axially slidable nose valve 28 is carried about the leading end of the nozzle housing 18 for normally closing the discharge ports 34 associated with the forward end of the nozzle housing. The retainer 38 extends radially outwardly a sufficient dimension to provide an engagement surface 60 for the nose sleeve as shown in FIG. 2. The nose sleeve 28 is urged against the retainer 38 by a coil spring 62. A rimmed surface seal 63, held in place between the retainer 38 and the rimmed surface 30, seals the rimmed surface 30 of the nozzle housing 18 with the nose sleeve 28 preventing external leakage when the fuel nozzle 10 is in the closed position.

The coil spring 62 abuts against the mounting flange 64 of the outer spring cover 58. The outer spring cover 58 is supported by a radial flange 66 of a collet 68. The collet 68, in turn, is carried on the nozzle housing 18 at a location spaced from the end 20 by a tapered flange 70 received on the nozzle housing 18. The spring 62 is held against the nozzle housing 18 by the outer spring cover 28 and the inner spring cover 52. Accordingly, the nose valve 28 is normally urged to a forward position closing the valve discharge ports 34, with a leading edge of the nose valve 28 in sealing engagement with a peripheral edge 72 of the front end of the nozzle housing 18.

Figure 3:
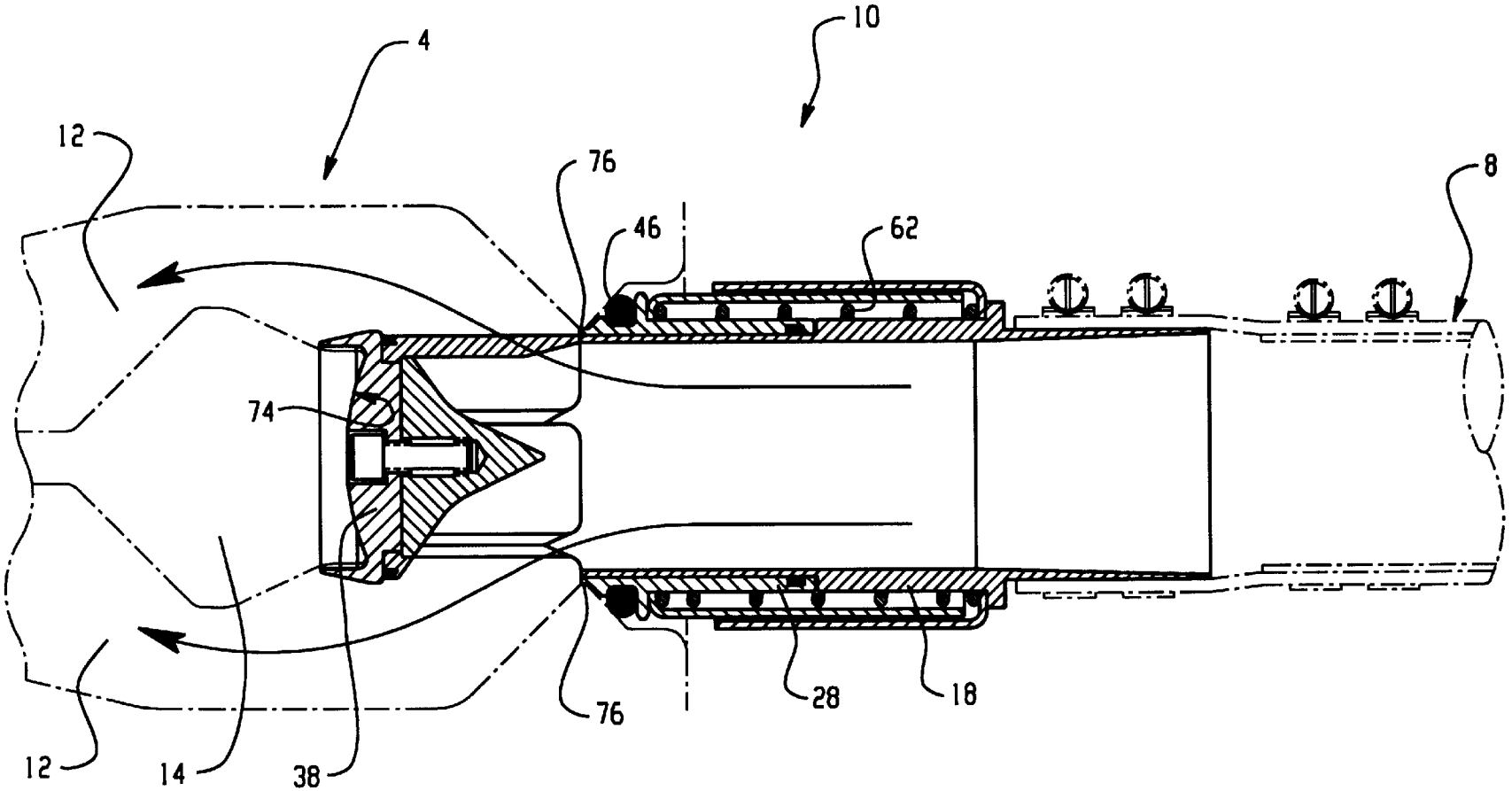
FIG. 3 is a sectional view illustrating full engagement of the fuel nozzle with the car receiver.

FIGS. 1 and 3 illustrate the fuel nozzle 10 in operative relation with the receiver 4 to achieve substantially optimum gravity flow rate of fuel to the car during a pit stop. Generally, the improved refueling nozzle 10 of the present invention is designed for rapid and easy, yet safe engagement and disengagement with the car receiver 4, so that fuel can be delivered in the shortest possible time but with little or no risk of fuel spillage.

When the fuel nozzle 10 initially engages the receiver 4, the retainer 38 is matingly and self-guidably received upon a concave shaped recess 74 defined by the shut-off valve member 14. As the retainer 38 contacts and moves the valve member 14 inward and into the fuel inflow port 12, the nozzle seal 46 (either the O-ring seal 46 of FIGS. 1 and 3 or the L-shape seal 46' of FIG. 2) seats on the protruding rim 76 of the receiver 4. Further axial or push-on movement of the nozzle 10 relative to the receiver 4 causes the retainer 38 and nozzle housing 18 to depress and open the shut-off valve member 14 which opens the fuel inflow port 12 of the receiver 4. At the same time, the nozzle housing 18 displaces forwardly relative to the nose sleeve 28 which is seated against the protruding rim 76, thereby fully opening the discharge flow ports 34 as viewed in FIG. 3.

The fuel nozzle 10, as described above, is disengaged from the car receiver 4 by mere pull-off removal, with the result that the poppet-type valve 18, 28, 38, 40 closes before the nozzle 10 disengages the receiver 4. More specifically, retraction of the fuel nozzle 10 from the car results in spring-biased advancement of the nose valve or sleeve 28 on the nozzle housing 18. Continued withdrawal of the fuel nozzle from the receiver 4 enables the spring 62 to effectively advance the nose valve 28 on the nozzle housing 18. This relative motion continues until the discharge ports 34 are closed. Once the ports 34 are closed, the fuel nozzle 10 disengages the receiver 4 without any fuel spillage.

The invention has been described with reference to preferred embodiments. Obviously, modifications and alterations will occur to others upon the reading and understanding of the preceding specification. It is intended that the invention be construed as including all such alterations and modifications insofar as they come within the scope of the appended claims or the equivalents thereof.

What is claimed is:

1. A refueling system for delivering fuel from a pitside fuel tank to a fuel cell on a race car, the refueling system comprising:

a receiver for delivering fuel to a fuel cell, the receiver comprising a fuel inflow port in fluid communication with the fuel cell and a shut-off valve, the shut-off valve biased toward a closed position and movable between the closed position closing the fuel inflow port and an open position allowing fuel to flow through the fuel inflow port;

a fuel nozzle having a hollow nozzle housing with a fuel flow passage and only a single flow valve for controlling flow therethrough, the flow valve biased toward a closed position and movable between the closed position preventing flow through the fuel flow passage and an open position permitting flow through the fuel flow passage, the flow valve only movable from the closed position toward the open position after the fuel nozzle is in sealing engagement with the receiver; and a hose for connecting the nozzle housing to a pitside fuel tank.

2. The refueling system of claim 1 wherein the flow valve is in the open position only while the fuel nozzle is in sealing engagement with the receiver.

3. The refueling system of claim 1 wherein the fuel nozzle is incapable of disengaging the receiver while the flow valve is in the open position.

4. The refueling system of claim 1 wherein the fuel nozzle can disengage the receiver only when the flow valve is in the closed position.

5. The refueling system of claim 1 wherein the flow valve is urged to a closed position by a biasing member.

6. The refueling system of claim 1 further comprising a seal attached to one of the nozzle and the receiver in abutting contact with the nozzle and the receiver, for preventing external leaks between the fuel nozzle and the receiver.

7. The refueling system of claim 1 wherein the flow valve is a poppet valve comprising an inner sleeve received within the outer sleeve, the inner sleeve having at least one axial opening, one of the inner sleeve and the outer sleeve movable relative to one another between a closed position where the outer sleeve closes the at least one axial opening to prevent fluid flow therethrough and an open position where the outer sleeve allows fluid flow through the at least one axial opening.

8. The refueling system of claim 7 wherein the poppet valve comprises a cone surface for directing axial flow through the nozzle radially outwardly through the at least one axial opening.

9. The refueling system of claim 7 wherein a spring urges the one of the inner sleeve and the outer sleeve to the closed position.

10. The refueling system of claim 7 wherein at least one of the inner sleeve and the outer sleeve comprises at least one seal for only allowing flow through the axial openings and only allowing such flow when the one of the inner sleeve and the outer sleeve is in the open position.

11. The refueling system of claim 1 wherein at least one of the nozzle and the receiver includes a mating surface for aligning the nozzle and the receiver during engagement.

12. The refueling system of claim 1 wherein the flow valve permits flow therethrough in an amount at least equal to the cross-sectional area of the fuel flow passage.

13. A race car refueling nozzle comprising:

a nozzle;

a single flow valve for controlling flow through the nozzle, the flow valve movable between a closed position preventing flow through the nozzle and an open position permitting flow through the nozzle;

a spring received in the nozzle for biasing the flow valve toward the closed position;

wherein the flow valve moves toward and remains in the open position only upon abutting engagement with the receiver while providing a leak-proof connection.

14. The refueling nozzle of claim 13 wherein the flow valve moves from an open position to a closed position before the nozzle is disconnected from the receiver.

15. The refueling nozzle of claim 13 wherein the nozzle comprises a seal for preventing fuel leakage between the nozzle and the receiver.

16. The refueling nozzle of claim 13 wherein the nozzle comprises a retainer for mating engagement with the receiver when the nozzle is connected to the receiver.

17. The refueling nozzle of claim 13 wherein the nozzle comprises an inner sleeve and an outer sleeve, the inner and outer sleeves together defining the flow valve.

18. The refueling nozzle of claim 17 wherein the inner sleeve includes at least one discharge port and the outer sleeve is movable between a closed position preventing flow through the at least one discharge port and an open position allowing flow through the at least one discharge port.

19. The refueling nozzle of claim 18 wherein the nozzle includes a conical surface for directing fluid from nozzle radially outwardly through the at least one discharge port.

20. The refueling nozzle of claim 18 wherein the at least one discharge port has a cross-sectional area at least equal to that of the nozzle.

21. The refueling nozzle of claim 18 wherein at least one seal is positioned between the inner and outer sleeves to prevent fluid flow leaks.

* * * * *